United States Patent [19]

Furutsu

[11] Patent Number: 4,465,217

[45] Date of Patent: Aug. 14, 1984

[54] FASTENER FEEDING METHOD AND MECHANISM

[75] Inventor: Akira Furutsu, Tokyo, Japan

[73] Assignees: Japan Bano'k Co., Ltd., Tokyo, Japan; Ben Clements & Sons, Inc., South Hackensack, N.J.

[21] Appl. No.: 364,571

[22] Filed: Apr. 1, 1982

[51] Int. Cl.[3] ..... A41H 37/00

[52] U.S. Cl. ..... 227/67; 198/626; 221/241; 221/253; 226/127; 226/134; 226/172; 227/109; 227/99

[58] Field of Search ..... 227/67, 120, 156, 109, 227/99; 198/626, 627, 628; 221/241, 253; 226/127, 428, 129, 134, 172

[56] References Cited

U.S. PATENT DOCUMENTS

| | | | |
|---|---|---|---|
| 3,978,969 | 9/1976 | Williams et al. | 198/626 X |
| 4,151,944 | 5/1979 | Picton | 227/120 |
| 4,288,017 | 9/1981 | Russell | 227/67 |
| 4,310,962 | 7/1982 | Suzuki | 227/67 X |
| 4,378,076 | 3/1983 | Stirnweiss | 226/129 X |
| 4,416,368 | 11/1983 | Muramatsu et al. | 498/626 X |

FOREIGN PATENT DOCUMENTS

| | | |
|---|---|---|
| 831212 | 1/1970 | Canada . |
| 1026051 | 2/1978 | Canada . |
| 1065588 | 11/1979 | Canada . |

*Primary Examiner*—Paul A. Bell

*Attorney, Agent, or Firm*—Blum Kaplan Friedman Silberman & Beran

[57] ABSTRACT

A method and a mechanism in and for a fastener dispensing operation, by which a plurality of fasteners individually comprising a filament having a head and an anchor bar at one and the other ends thereof and altogether integrally formed to a fastener assembly can be fed to a fastener-severing position in a fastener dispensing device one at a time of the fastener dispensing operation by the dispensing device even in case of an irregularity or a change in the inter-fastener pitch in the fastener assembly.

8 Claims, 6 Drawing Figures

FASTENER FEEDING METHOD AND MECHANISM

BACKGROUND OF THE INVENTION

The present invention relates to a method and a mechanism in and for a fastener dispensing operation, by which fasteners can be fed in a securely guided manner in the dispensing device, one at a time of the operation of the dispensing device. More particularly, the invention relates to such a method and mechanism in and for a fastener dispensing operation by which member fasteners integrally formed in a group or assembly can be individually successively fed to a prescribed position in the dispensing device in an orderly manner even in case the fastener assembly has member fasteners formed in irregular pitches.

Fasteners herein termed are typically such ones which are widely known as tagging pins or, more simply, tag pins normally molded from a plastic material integrally in groups and which are individually severed and dispensed one at a time by a dispensing device typically in fastening price tags or the like to merchandise or for purposes of connecting two or more items of merchandise to a unitary arrangement, for example for putting merchandise in pairs. Thus, the invention will be described and illustrated, by way of example, in connection with such tag pins.

Tag pins individually comprise a filament of a certain length which is not much great, an anchor bar formed at one or a lower end portion of the filament and a head formed at the other or upper end of the filament, all of which are integrally molded from a plastic material such as nylon for example. In the manufacture of such tag pins, they are formed in groups or assemblies each having a number of member pins connected in a row through a connecting member or members comprising for example a connecting bar, which is also called a guide bar. Then, in dispensing tag pins to thereby attach for example price tags to merchandise, it is operated to load a tag pin group or assembly in a dispensing device also called a tag attacher which has a pistol-like overall configuration and includes an application hollow needle and a trigger. Further, when the needle of the dispensing device is applied through a price tag and further through an object item of merchandise, the trigger is pulled, whereby a first pin is severed from the loaded tag pin assembly and becomes pushed out of the device through the needle. Then, the needle is pulled back out of the object item of the merchandise and the price tag, to accomplish a first cycle of the tag attaching operation, which operation will be recycled to fasten a number of tags to the corresponding number of object items of merchandise.

With tag pins today widely utilized in the described or other similar manners, their material comprise plastics for example nylon as before mentioned, and in consideration of lately developed various difficulties to do with petroleum, tag-pin manufacturers have tended to maximum curtail the consumption of material plastics by making each tag pin assembly having as great a number of its member pins as possible with the length minimized of the connecting bar which is simply discarded as waste when some or the whole of individual tag pins which the guide bar connects altogether to the assembly have been dispensed. The guide bar has a greater diametral size than tag pins or their filaments, and in terms of the amount consumed of the plastic material, it reaches 30 to 40% of a single tag pin group, so that it means an extreme importance to tag-pin manufacturers to make shorter the length of the connecting bar or guide bar relative to the number of tag pins which the guide bar carries thereon. To provide a greater number of tag pins with the length of the guide bar unchanged naturally results in a reduction in the inter-pin pitch in tag pin groups. In this connection, with conventional tag-pin dispensing devices, they are so structured as to rely, for means for feeding tag pins to their severing position in the device, on such a mechanism in which tag pins are engaged by teeth of a rotatable toothed wheel and fed through rotation of the wheel. Thus, in case of a change in the inter-pin pitch for example a reduction in the pitch as mentioned above, it inconveniently is indispensable with conventional tag attachers to accordingly change the pitch of the toothed wheel or, more practically, replace a currently employed toothed wheel by another one having a pitch suited to the changed inter-pin pitch.

SUMMARY OF THE INVENTION

It is therefore an object of the present invention to provide a method and a mechanism in and for a fastener or tag-pin dispensing operation, by which tag pins can be without fail fed to their severing position in the tag attacher even in dispensing a tag pin assembly having irregular inter-pin pitches or tag pin assemblies having varied inter-pin pitches.

It is another object of the invention to provide a method and a mechanism in and for the tag-pin dispensing operation, by which tag pins can be fed to their severing position in the dispensing device in a guide controlled manner in the dispensing device.

To attain the above and other objects which will appear as the description proceeds, the present invention provides a method for feeding to a fastener-severing position in a fastener dispensing device a plurality of fasteners which individually comprise a filament having a head at one end thereof and an anchor bar formed at the other end thereof to extend perpendicular to a connecting member connecting said fasteners altogether integrally to a fastener assembly and which are individually successively dispensed by the dispensing device one at a time of the fastener dispensing operation, which method comprises providing to the fastener dispensing device a fastener guide path formed between a pair of holding means and feeding fasteners along said guide path in a manner of the fastener assembly being held between said pair of holding means.

The invention also provides a mechanism to be provided to a fastener dispensing device for feeding to a fastener-severing position in the dispensing device a plurality of fasteners which individually comprise a filament having a head at one end thereof and an anchor bar formed at the other end thereof to extend perpendicular to a connecting member connecting said fasteners altogether integrally to a fastener assembly and which are individually successively dispensed by the dispensing device one at a time of the fastener dispensing operation, which mechanism comprises a pair of holding means for holding therebetween a fastener assembly loaded in the fastener device and advancing means for intermittently feeding said holding means in the prescribed feeding direction in the dispensing device.

DESCRIPTION OF THE PREFERRED EMBODIMENTS

With reference to the accompanying drawings, the present invention will now be described in greater detail.

Figure 1:
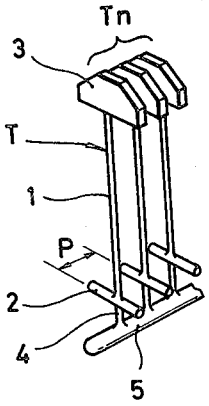
FIG.1 PRIOR ART
FIG. 1 is a perspective view, showing a part of a prior art tag pin group or aassembly.

Initially in FIG. 1, there is shown in a perspective view a part or portion of an assembly or group Tn of tag pins T. Each tag pin T consists of a filament 1 which has at its upper end a head 3 of a hexagonal shape when viewed in the axial direction of a guide bar 5 and at a portion of its other or lower end an anchor bar 2 formed crossing the filament 1 and extending perpendicular to the axial direction of the guide bar 5, which is also called a connecting bar and which connects a number of tag pins altogether in an inter-pin pitch P to form the tag pin group or assembly Tn, through a connecting neck 4 of respective pins T.

Figure 2:
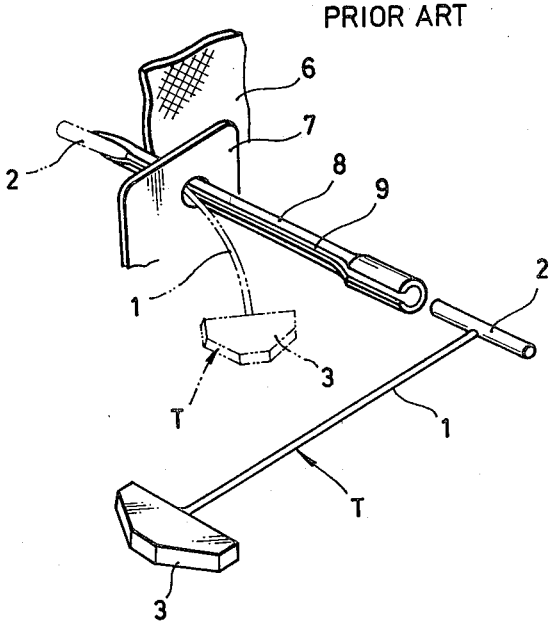
FIG.2 PRIOR ART
FIG. 2 also is a perspective view, taken for illustration of the prior art manner in which individual tag pins are being dispensed.

Member tag pins T of a tag pin assembly Tn loaded in a dispensing device (FIG. 3) are individually severed one at a time of the dispensing operation and fed into a hollow application needle 8 of the dispensing device as shown in FIG. 2. Further, as shown by phantom lines in FIG. 2, the anchor bar 2 of the pin T is driven in the hollow of the needle 8 toward the forward end thereof, while the filament 1 being guided as protruding out of the needle 8, along a lateral slit 9 of the needle. In dispensing each pin T, the needle 8 is pierced first through a price tag or the like 7 and then into merchandise 6, and thereafter the dispensing device may be operated to shoot a tag pin out of the needle so that the anchor bar 2 of the shot pin may be applied through the merchandise 6 from one to the other side faces thereof, upon which the needle may be retracted out of the merchandise 6 and the price tag or the like 7, allowing the anchor bar 2 of the shot tag pin to be disengaged from the needle and to restore its original position perpendicular to the guide bar 5.

Then, with reference transferred mainly to FIGS. 3 through 6, the invention will be described in connection with specific embodiments thereof.

Figure 3:
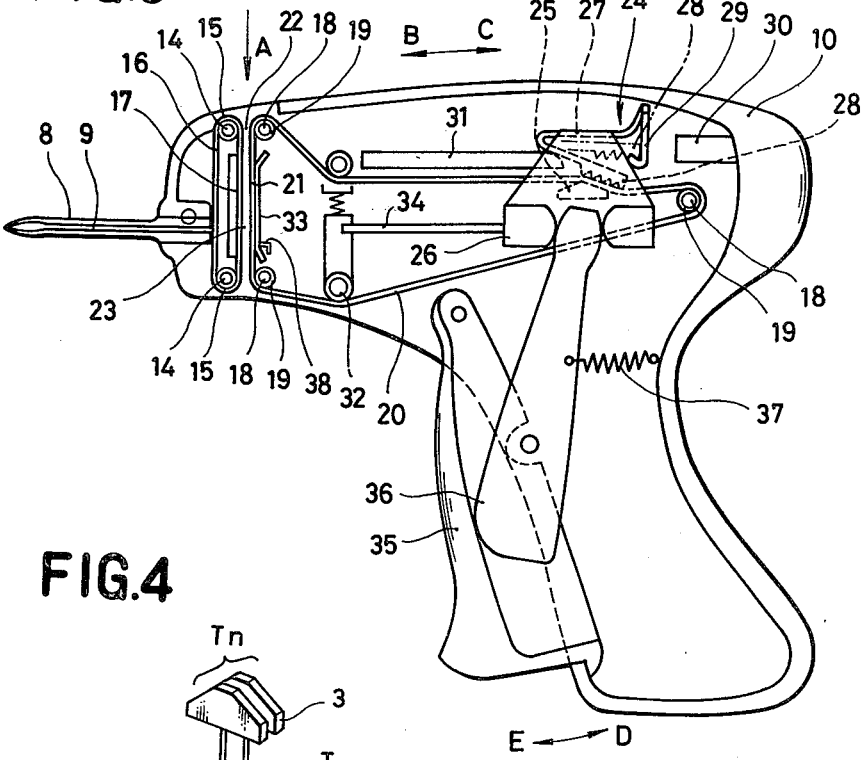
FIG. 3 is a front view, showing the body of a tag-pin dispensing device depicted with a half part thereof removed away, representing a first embodiment of the present invention.
Figure 4:
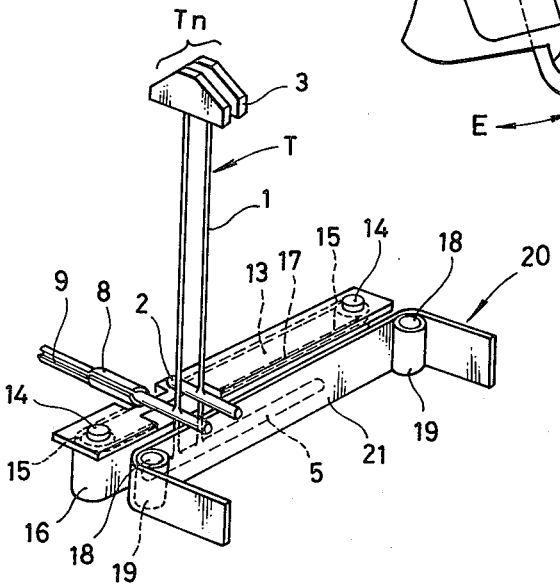
FIG. 4 shows a perspective view of essential parts of the first embodiment of the invention.

As shown in FIG. 3, in a forward end portion of the body 10 of a pistol-type dispensing device often referred to also as a tag attacher, there is removably fixed the hollow needle 8 provided with the lateral slit 9 communicated with the central hollow of the needle for passing the filament 1 and the anchor bar 2 of tag pin T through. Then, rear of the rear end of the needle 8, a cutter member 13 is disposed, which lies to cross the axis of the needle 8 as shown in FIG. 4. The cutter member 13 is for severing a tag pin T from the assembly Tn at a point of the former at which the anchor bar 2 and the connecting neck 4 are connected together, and it is supported by fitting by a pair of spaced fixed pins 14 mounted to the body 10. Each pin 14 supports a roller 15 rotatably fitted thereto, and an endless belt 16 is mounted on the two spaced rollers 15. The straight run portions 17 of the endless belt 16 lie substantially parallel to the cutter member 13.

Opposing the belt 16, there is also provided a further endless belt 20 which is mounted on three rollers 19 supported by fixed pins 18 secured to the body 10. This endless belt 20 is greater in size than the other endless belt 16, and its straight run part 21 extends substantially parallel to the straight run portions 17 of the endless belt 16. It will readily be appreciated that the endless belts 16 and 20 are so disposed as to form a guide path 22 for the guide bar 5 of tag pin assembly Tn with their parallel disposed straight run portions 17 and 21. In operation, the guide bar 5 is held between the straight run portions of the endless belts, and the guide bar and accordingly the tag pin assembly Tn is fed, through the friction force then applied, toward a pin-severing position 23 (in the direction shown by arrow A). This feeding of the tag pin assembly is effected by driving the larger endless belt 20 to move in the direction of the arrow A so as to transfer the guide bar 5 of the tag pin assembly Tn and the smaller endless belt 16, and the driving of the larger endless belt 20 is made through the function of mutually engaging belt feeding pawl 24 and belt support member 25, which together are so arranged as to be put for a linear motion in the direction shown by an arrow B, together with a pushing-rod carrier 26 later to be described. That is to say, the belt support member 25 is fixed to the pushing-rod carrier 26, as well as the pawl 24 which is fixed at its mounting part 27 which intermediately is bent into a U-letter shape to provide at a leading end portion thereof an elastic engagement part 28. Thus, as shown by solid lines in FIG. 3, the elastic engaging part 28 and the belt support member 25 engage each other to hold the larger endless belt 20 between them and drive the belt to move. Further, the other end portion of the mounting part 27 is formed to comprise a hook 29 which is elastically movable in directions perpendicularly through the plane of the drawing sheet of FIG. 3. When it lies on a wedge 30 formed to internally protrude from an edge portion of the body 10, the hook can move in a direction from the rear to the front sides of the drawing sheet, while it moving in the opposite direction to return to its original position when it is disengaged from the wedge 30. In the body 10, there also is provided a freeing plate member 31 for the belt support member 25 and the elastic engagement part 28. This plate member 31 is elongated in directions shown by a bilateral arrow B-C, and when the elastic engagement part 28 and the belt support member 25 have transferred the endless belt 20 a prescribed distance in their mutually engaged condition for transferring the belt, it functions to force the elastic engagement part 28 to deflect to come into engagement with the hook 29 as shown by phantom lines, whereby the belt 20 is freed from the holding between the part 28 and the member 25.

The larger endless belt 20 is constantly under a tension application by a tensioning roller 32, and in its straight run portion 21, it is constantly forced toward the smaller endless belt 16 by an elastic guide plate 33.

Then, the driver carrier 26 is received by fitting in a guide groove (not shown) in the body 10 so as to be movable in the guide groove in the directions shown by the bidirectional arrow B-C. This carrier 26 has secured at its forward end a driver 34 the axis of which is aligned with the axis of the needle 8 and which pushes into the hollow of the needle 8 a tag pin T cut and severed by the cutter member 13 from the tag pin assembly Tn in the pin-severing position. Further, the driver carrier 26 is driven in the direction B of the arrow B-C through the operation of levers 35 and 36, and is returned to its original position by the function of a spring 37.

At a location in the body 10 below the location of the needle 8, there also is provided a stopper 38, which is for positioning on the axis of the needle 8 the anchor bar 2 of a first tag pin T of the tag pin group Tn loaded in the dispensing device and fed therein in the direction of arrow A.

Now, an explanation will be entered in connection with the tag-pin dispensing operation with the above-described device according to a first embodiment of the invention.

A tag pin assembly Tn as shown in FIG. 1 may be loaded through its guide bar 5 in the guide path 22 formed between the straight run portion 21 of the larger endless belt 20 and its facing straight run portion 17 of the smaller endless belt 16. When the lever or trigger 35 may then be rotated in the direction shown by D of a bilateral arrow E-D, the driver carrier 26 commences through the motion of the lever 36 a motion in the direction of B of the arrow B-C. At this stage, the elastic engagement part 28 of the belt feeding pawl 24 is in the position shown by solid lines in FIG. 3 and together with the belt support member 25, holds the larger endless belt 20 in a nip-held state of the latter, so that accompanying the transfer of the driver carrier 26, the belt 20 also moves in the direction shown by B of the arrow B-C, that is, in the direction shown by arrow A with respect to its straight run part 21, whereby through a friction force the guide bar 5 of the loaded tag-pin assembly Tn is sent in the direction of the arrow A together with the smaller endless belt 16 until the condition is reached in which the anchor bar 2 of a first or lowest located pin T abuts against the stopper 38 and its positioning is thus set. At this stage, if the larger endless belt 20 is still in a condition of being bit by the pawl 24 and the support 25, that is, if the distance in which the belt 20 is sent by a single operation of the lever 36 exceeds the inter-pin pitch of the tag pin group, the tensioning roller 32 is allowed to move upward in FIG. 3 so that no excessive force application may be made on the belt 20 and accordingly the tag pin group Tn. Thus, while the tag pin group Tn has been driven an enough distance in the direction of the arrow A, the driver carrier 26 can continue to move in the direction shown by B of the arrow B-C, and the elastic engagement part 28 of the pawl 24, which is deflected by the freeing plate 31 to its position shown by the phantom lines in FIG. 3 and becomes engaged with hook 29 then, continues in that state to be further transferred in the direction shown by B of the arrow B-C together with the pushing-rod carrier 26. As soon as the engagement part 28 is engaged by hook 29 as above, the belt 20 becomes in a freed condition and stops moving. The rod carrier 26 still moving in the direction of B of the arrow B-C pushes with its carrying driver 34 the anchor rod 2 of the tag pin T located at the pin-severing point 23, whereby a first tag pin T is severed by cutting of the cutter member 13 (FIG. 4) at its portion at which the anchor bar 2 and the connecting neck 4 are joined together and it may then be applied through the article or ware 6 as shown in FIG. 2.

Then, the lever or trigger 35 may be put in a free condition, whereupon the intermediate lever 36 is permitted to undergo a return stroke by the function of the spring 37, whereby the trigger 35 and the pushing-rod carrier 26 are permitted to return to their respective original positions. At the same time as this, the belt feeding pawl 24 and the belt support member 25 undergo their return stroke in the direction shown by C of the arrow B-C, and in this case, the elastic engagement part 28 of the pawl 24 moves in its position engaged by the hook 29 as shown by the phantom lines, so that the belt 20 is not caused to move. When the pawl 24 is moved to a terminal point of its return stroke, the hook 29 is caused by the wedge 30 to move toward this way relative to the plane of the drawing sheet of FIG. 3, so that the elastic engagement part 28 becomes disengaged from the hook 29 and, due to its elasticity, returns to its solid line position to again bite the belt 20 together with the member 28.

By feeding a tag pin assembly Tn in the described manner, individual tag pins T can be without fail sent to the pin-severing position in the dispensing device even if the inter-pin pitch P involves an error or irregularity, or if tag pin assemblies varied in the inter-pin pitch are to be dispensed.

Further, in case tag pin assemblies to be dispensed all are the same in respect to the inter-pin pitch, it may well be devised to adjust the location of the freeing plate member 31 in either of the directions shown by the bilateral arrow B-C in accordance with the specific pitch P of tag pins T and so that the distance in which the belt 20 is to be sent for each operation time corresponds to the inter-pin distance. In making this arrangement, the tensioning roller 32 can be dropped, advantageously.

Whereas in the foregoing described embodiment of the invention it is made that the tag pin group is fed with its guide bar 5 held between longer and shorter endless belts 20 and 16, the present invention is not limited to such arrangement only and, according also to the invention, it may be made to carry out the feeding or sending of the tag pin assembly with the filament 1 of tag pins T held in a clamped or nip-held state. In this case, the lower one of rollers 15 in FIG. 3 for the smaller endless belt 16 may be reduced as much as possible in its diametral size and, at the same time, the location of the pin-severing position 23 may be brought as low as possible below the diameter-reduced roller 15 so that the sending of a last tag pin T of a tag pin assembly to the severing position 23 can be facilitated. Also in this case, in lieu of the roller 15, the lower fixed pin 14 may be made as thin as possible for the same purpose as above of making further facilitated the transfer of filaments 1 toward the needle 8.

Figure 5:
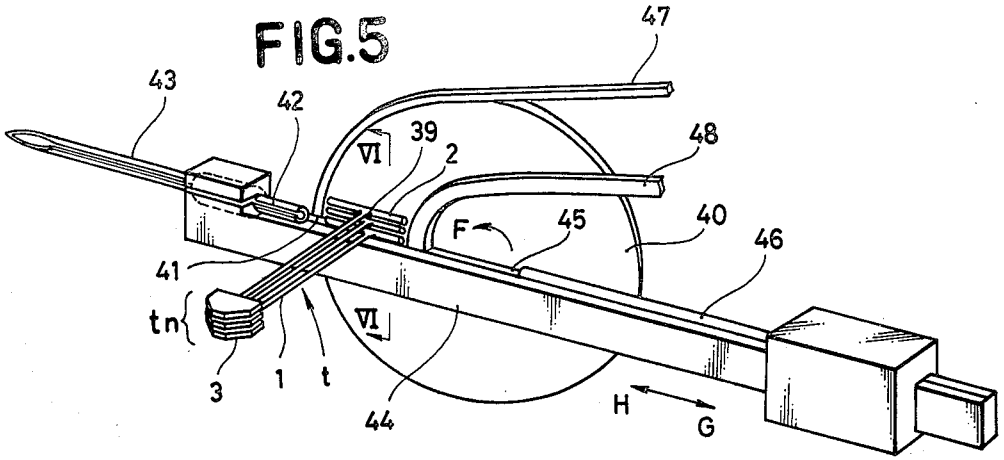
FIG. 5 shows in a perspective view a second embodiment of the invention.
Figure 6:
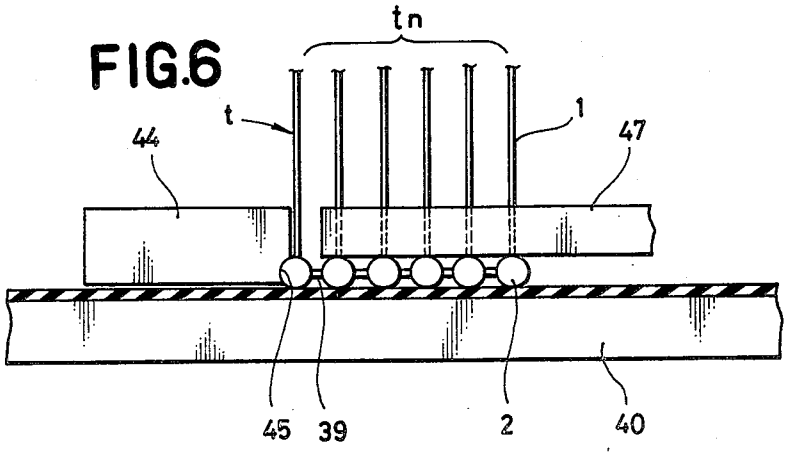
FIG. 6 shows a schematic sectional view taken along line VI—VI of FIG. 5.

As shown in FIGS. 5 and 6, there are cases where tag pins t are connected to form a tag pin assembly tn through connecting hands 39 formed between each adjacent anchor bars 2. With these tag pin assemblies tn, the before mentioned guide bars 5 can be removed, whereby an economization is realized of the consumption of the material resin. For the handling of such tag pin assemblies, it may be devised to provide to the dispensing device a disk plate 40 as shown in FIG. 5, which is rotatable in the direction shown by an arrow F and which sends the anchor bar 2 of each tag pin to the pin-severing position indicated at 41, through a friction force. Further, for the severing of tag pins individually at their respective connecting hands 39, a cutter member 42 having a C-shaped cross-section may be integrally secured to needle 43, and also a groove 45 (FIG. 6) may be formed in a needle carrier 44 for the needle 43. With the above arrangement, the anchor bar 2 of a first or lowest located tag pin t of a tag pin assembly tn sent through a friction force applied by the rotatable disk plate 40 may be received in the groove 45, and in that condition, the needle carrier 44 may be driven in the direction of G of a bidirectional arrow H-G. Further, while the cutter member 42 is thus moved in the direction of G receiving anchor bar 2 increasingly deeply in the hollow thereof, the driver indicated by 46 may be driven in the opposite direction shown by H of the arrow H-G, whereby the first pin t can be severed from the assembly tn and driven through the needle 43. Whereas in this embodiment the anchor bars 2 are sent by the rotation of the disk plate 40 in their state of being held between a pair of fixed members 47 and 48, it may alternatively be devised to hold the anchor bars 2 between a pair of rotatable disk plates.

According to the embodiment of the invention described above in conjunction with FIGS. 5 and 6, the needle 43 can be adapted to come in and out of the body (not shown) of the tag-pin, so that with the dispensing device out of operation, the needle 43 may be retracted inside the body to thereby secure safety; not only that, but also is it that simply with tags disposed in front of the needle 43 and through any automated means, it can be made to let the needle automatically pierces the tags one at a time of the operation of the dispensing device, whereby an automatic tagging operation can with ease be performed.

As described above, according to the present invention, tag pin assemblies can be fed in a tag-pin dispensing device to the pin-severing position even in case of a change in the inter-pin pitch. Also, the feeding or sending of tag pins to the pin-severing position in the dispensing device can be securely, smoothly made even in connection with a last pin in a tag pin assembly.

What is claimed is:

1. A device for dispensing sequentially a plurality of fasteners one at a time for each operation of the device, each said fastener including a filament having a head at one end thereof and an anchor bar at the other end thereof, said fasteners being coupled in sequence to a guide bar to form an integral fastener assembly, comprising a body having a front end which supports a hollow slitted needle, an operation lever pivotably coupled to said main body, a driver operatively coupled to said operation lever and adapted to push a fastener in alignment with said needle in a fastener-severing position through said needle, a pair of spaced endless belts supported on said main body which hold said guide bar therebetween, and advancing means operatively coupled to said operation lever for moving at least one of said endless belts to feed the next successive fastener to said fastener-severing position upon operation of said operation lever.

2. A method for feeding sequential fasteners in a fastener assembly to a fastener-severing position in a fastener dispensing device, each said fastener including a filament having a head at one end thereof and an anchor bar formed at the other end thereof to extend essentially perpendicular to a connecting member connecting said fasteners to a guide bar to form said fastener assembly, said fasteners being individually successively dispensed by the dispensing device one at a time during each fastener dispensing operation, which method comprises the steps of positioning said guide bar of said fastener assembly in a fastener guide path formed between a pair of spaced, endless belts and selectively feeding said fastener assembly by means of said guide bar along said guide path by moving at least one of said endless belts upon each operation of said device.

3. A method as claimed in claim 2, wherein said connecting member of the fastener assembly comprises connecting necks of respective fasteners coupled to said guide bar to form the fastener assembly and wherein fasteners are fed with said guide bar held between the pair of endless belts.

4. A mechanism for use in a fastener dispensing device for feeding sequential fasteners in a fastener assembly to a fastener-severing position in the dispensing device, each said fastener including a filament having a head at one end thereof and an anchor bar formed at the other end thereof to extend essentially perpendicular to a connecting member connecting said fasteners to a guide bar to form said fastener assembly, said fasteners being individually successively dispensed by the dispensing device one at a time during each fastener dispensing operation, which mechanism comprises a pair of spaced, endless belts for holding therebetween a fastener assembly loaded in the fastener dispensing device and advancing means for intermittently moving at least one of said endless belts to feed the next successive fastener to said fastener-severing position.

5. A mechanism as claimed in claim 4, wherein said advancing means includes controlling means for setting the distance at which said at least one endless belt is moved at each fastener dispensing operation.

6. A mechanism as claimed in claim 5, wherein said controlling means comprises a stopper for effecting the positioning of the fastener assembly and a tensioning roller for maintaining constant the tension on one of the endless belts.

7. A mechanism as claimed in claim 6, wherein said tensioning roller is pressed against said one of the endless belts through spring means.

8. A mechanism as claimed in claim 4, wherein said advancing means includes a belt feeding pawl and a belt support member which hold one of the endless belts and, operatively in association with a trigger of the fastener dispensing device, feed the endless belt.

* * * * *